US005660563A

United States Patent [19]

Chevarie et al.

[11] Patent Number: 5,660,563

[45] Date of Patent: Aug. 26, 1997

[54] ASSEMBLY OF MULTI-TERMINAL TELECOMMUNICATIONS CONNECTORS AND TERMINALS

[76] Inventors: Benoit Chevarie, 4459 rue Descartes, Boisbriand, Quebec, Canada, J7G 3A6; Guy Chapdelaine, 856 Toussaint-Bénard, Boucherville, Quebec, Canada, J4B 4G4

[21] Appl. No.: 386,385

[22] Filed: Feb. 10, 1995

[51] Int. Cl.[6] ..... H01R 31/08

[52] U.S. Cl. ..... 439/512; 439/189; 439/885

[58] Field of Search ..... 439/512, 189, 439/885, 513

[56] References Cited

U.S. PATENT DOCUMENTS

| | | | |
|---|---|---|---|
| 3,249,905 | 5/1966 | Ruehlemann | 439/189 |
| 3,955,877 | 5/1976 | Cobaugh et al. | 439/885 X |
| 4,030,793 | 6/1977 | Hanlon et al. | 439/189 |
| 4,377,321 | 3/1983 | Weisenbeurger | 439/885 X |
| 4,607,899 | 8/1986 | Romine et al. | 439/512 |
| 4,712,299 | 12/1987 | Loewen et al. | 439/885 X |
| 5,326,275 | 7/1994 | Murakami | 439/189 |
| 5,417,589 | 5/1995 | Terada | 439/885 X |
| 5,456,617 | 10/1995 | Chishima et al. | 439/189 X |

*Primary Examiner*—Jes F. Pascua

*Attorney, Agent, or Firm*—Wolf, Greenfield & Sacks, P.C.

[57] ABSTRACT

Multi-terminal position connector with a row of terminals in which selected terminals are electrically connected together by a conductive strip formed with the terminals as a single one piece unit. Preferably the selected terminals each has a base which connects a box terminal end and an insulation displacement terminal end and the conductive strip extends integrally from the base. Also included is a method of making the connector in which the selected terminals are inserted into their terminal position after the other terminals have been inserted, the selected terminals being inserted with the conductive strip as a one piece unit.

6 Claims, 6 Drawing Sheets

ASSEMBLY OF MULTI-TERMINAL TELECOMMUNICATIONS CONNECTORS AND TERMINALS

BACKGROUND

1. Field of the Invention

This invention relates to assemblies of multi-terminal telecommunications connectors and terminals.

2. Related Art

Multi-terminal position telecommunications connectors are known having one or more rows of terminal positions in close proximity to one another to provide a dense terminal configuration. Terminals of this sort are used, for instance, for a connection into back planes or printed circuit boards in telecommunications equipment. It is normally to be expected that each of the terminals when inserted into its terminal position is electrically connected at one end to an incoming insulated wire to provide connections into and out of the back plane. To locate terminals into a multi-terminal position connector, conventionally a bandoiler of terminals is provided, the terminals extending laterally of the bandolier while being spaced apart lengthwise of the bandolier and connected at their ends to two bandoiler edge strips extending the full length of the bandolier. Lengths of bandolier appropriate to the connector length are severed from the bandolier, and with one of the edge strips removed, terminals of each severed length are inserted simultaneously into terminal positions of the corresponding connector and then the other edge strip is removed to electrically isolate the terminals. In some connectors, the terminal positions are too close together for the minimal allowable spacing of terminals on a bandolier, and in such cases, the bandolier has its terminal spacing equal to twice the terminal position spacing on the connector. In such cases, one bandoiler length provides terminals for one group of alternate terminal positions and another bandolier length provides the terminals for the remainder, or other group, of positions. After the terminals are in their terminal positions, selected terminals which are required to be electrically connected together to provide loop conductors into and out of a back plane or a printed circuit board, are bridged together using short conductor wires which are connected into insulation displacement terminal ends of the terminals.

The above conventional manner of bridging selected terminals has distinct disadvantages. Short conductor wires for bridging terminals are connected in intricate fashion which is time consuming with terminal spacing being perhaps of the order of-mm apart. With connectors being placed close together in dense terminal configurations at the rear of a back plane it is also preferable to locate wire bridges in the confines of the plane of the connector itself. This adds to the difficulty of the accomplishment of the bridging operation. Further, with the use of wires extending between the insulation terminal ends it is difficult, and perhaps impossible, for connecting one single terminal to two other terminals because in that one terminal, two wires need to extend into the same insulation displacement terminal end. For the same reason, it is difficult, if not impossible, to connect an incoming conductor wire to a terminal which is bridged with another terminal. This places certain design restrictions on any back plane or printed circuit board using bridged terminals.

SUMMARY OF THE INVENTION

The invention seeks to provide a multi-terminal position telecommunications connector and terminal assembly and a method of assembling terminals to such a connector which minimizes or avoids the above problems.

According to one aspect of the present invention there is provided a multi-terminal position telecommunications connector and terminal assembly comprising a telecommunications connector having a housing and a plurality of terminal positions disposed in at least one row, and a row of electrical terminals received in the terminal positions within the housing, selected ones of said terminals being electrically connected together by a conductive strip extending from selected terminal to selected terminal and with the selected terminals and the conductive strip forming a single one piece unit.

With the above structure, as the conductive strip and the selected terminals are formed together as a single unit, the metal of the unit extends from terminal to terminal devoid of a joint and no weakness, such as results from a joint is produced. In addition, the conductive strip is easily provided so as to lie in the plane of the connector itself. A conductive strip may connect three or even more terminals which are selected.

In addition, the present invention also provides a method of making a telecommunications connector comprising: providing a housing having a row of terminal positions within the housing for electrical terminals; providing a plurality of electrical terminals for location in each of the mounting positions; and inserting the terminals one into each of the mounting positions with selected ones of said terminals electrically connected together by a conductive strip extending from selected terminal to selected terminal and with the selected terminals and the conductive strip forming a single one piece unit, and with others of the terminals electrically insulated from one another and from the selected terminals. Conveniently, the other terminals are provided by a bandolier of terminals and these other terminals joined by edge strip means along one edge of the bandolier are located into terminal positions provided for these terminals and the edge strip means is subsequently removed so as to isolated these other terminals from one another. The unit of the selected terminals together with the conductive strip extending between them is then disposed in the terminal positions for these terminals. Conveniently, the selected terminals are also severed from a bandolier with the conductive strip provided by an edge strip of the bandolier.

BRIEF DESCRIPTION OF THE DRAWINGS

One embodiment of the invention will now be described, by way of example, with reference to the accompanying drawings, in which.

DETAILED DESCRIPTION

Figure 1:
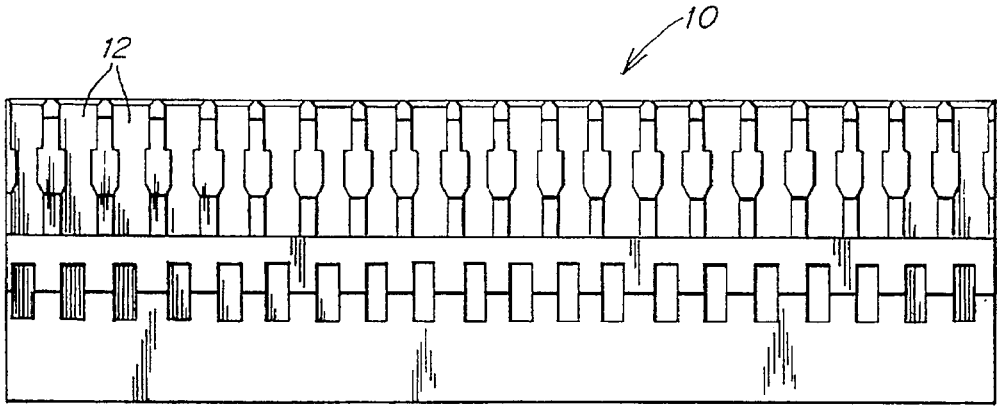
FIG. 1 (PRIOR ART)
FIG. 1, is a plan view of a multi-terminal telecommunications connector according to the prior art.
Figure 2:
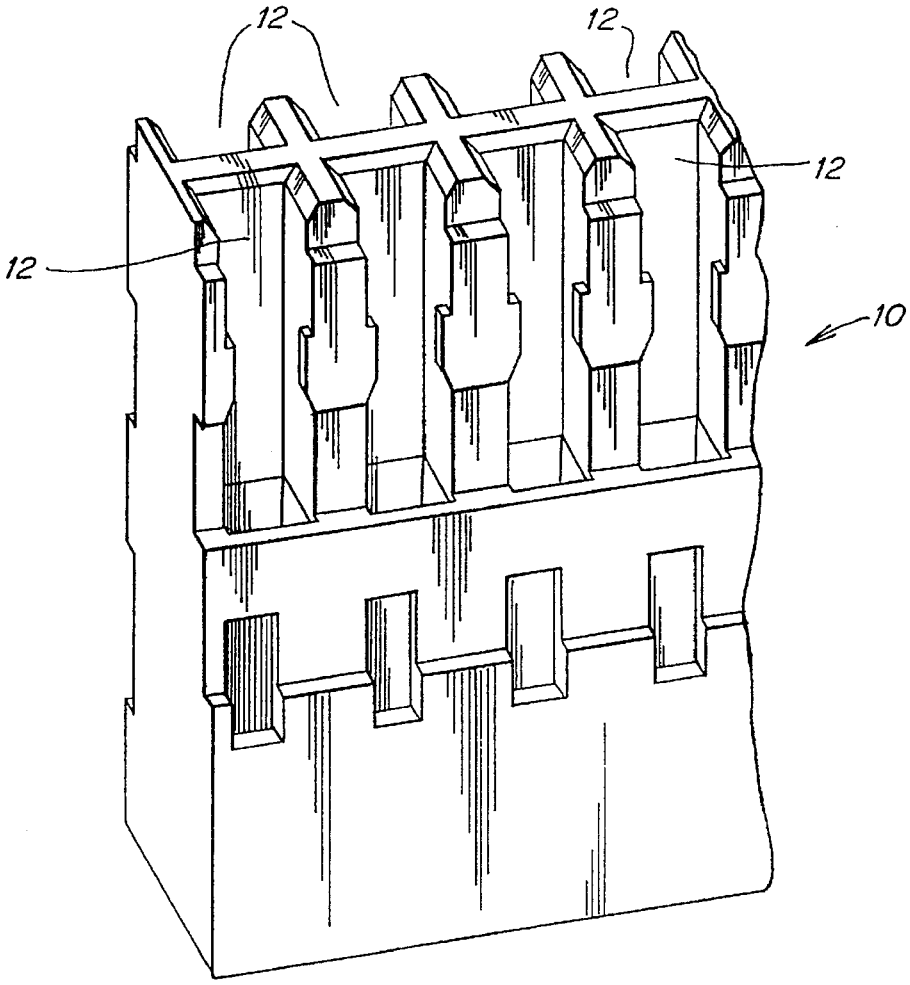
FIG. 2 (PRIOR ART)
FIG. 2 is an isometric view to a larger scale of part of the connector shown in FIG. 1.
Figure 3:
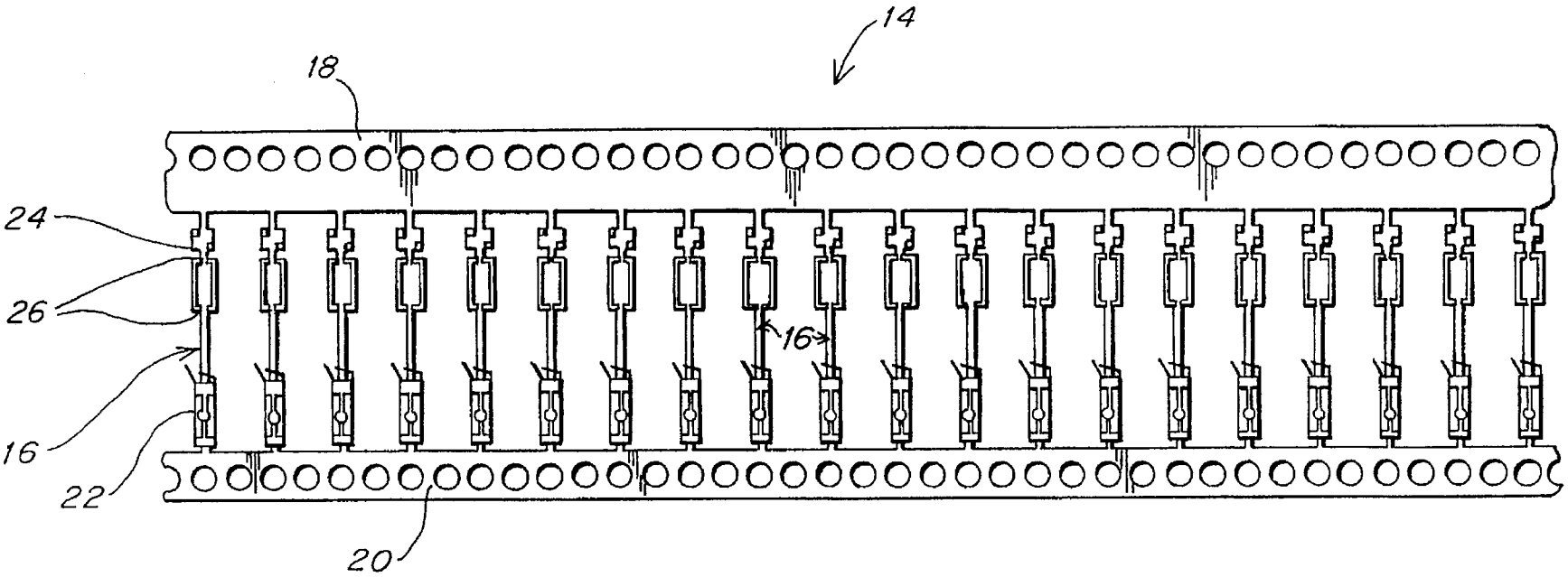
FIG. 3 (PRIOR ART)
FIG. 3 is part of a prior art bandolier of terminals for insertion into the connector of FIGS. 1 and 2.

FIGS. 1 and 2 show a prior art connector 10 having multi-terminal positions 12 arranged in two back-to-back rows along the length of the connector. In FIG. 3, a bandolier 14 of terminals 16 is shown, the terminals 16 being disposed in laterally spaced apart positions along the length of the bandolier with each terminal extending widthwise of the bandolier. The terminals are connected together along the length of the bandolier by strip means comprising a wide edge strip 18 and a narrower edge strip 20 at opposite side edges of the bandolier. The terminals are formed by a metal pressing operation and because of the requirement of the amount of metal needed for each terminal, the minimal terminal spacing is limited. As this terminal spacing cannot be made as small as the spacing between the terminal positions 12 in each row, it is intended in this conventional process the locate the terminals 16 on the bandolier 14 at spacing positions equal to twice the distance apart of the terminal positions 12 in each row for reasons to be described. In well known manner each of the terminals 16 is elongate and has at one end a terminal box 22 for receiving in electrical contact a male pin of a back plane or printed circuit board or other connector to which the terminal is to be connected. At the other end 24 the terminal is formed with insulation displacement means 26 of well known form for severing through insulation of an incoming conductor wire for electrical connection to the electrical wire within.

Figure 4:
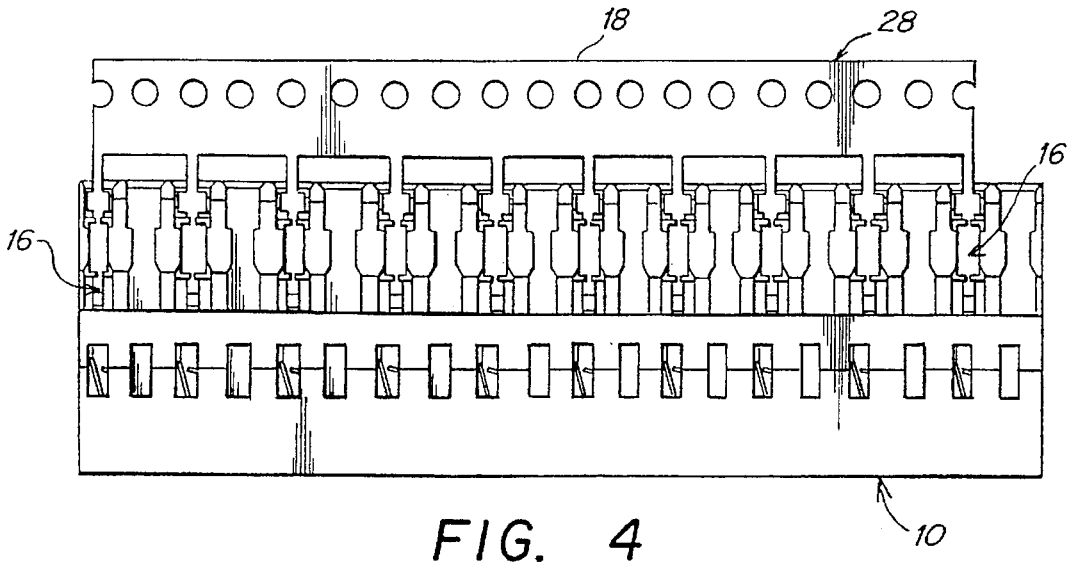
FIG. 4 (PRIOR ART)
FIG. 4 is a view similar to FIG. 1 showing one stage in the process of assembling terminals from bandoliers into the prior art connector of FIG. 1.

To assemble terminals 16 into the connector 10, a length of the bandolier 14 corresponding to the length of the connector 10 is severed from the remainder and the edge strip 20 of this length is removed so that the terminals 16 are connected together at their ends 24 only by the edge strip 18 This length 28 of the bandolier is then applied to the connector as shown in FIG. 4 and the terminals of this length 28 are inserted into alternate terminal positions 12 in conventional manner with the other terminal positions 12 remaining unoccupied by terminals at this stage. The edge strip 18 is then removed (not shown) and another appropriate bandolier length which has been removed from the bandolier has its terminals 16 inserted into the other terminal positions 12 in similar manner. The other row 12 of terminal positions is likewise occupied by terminals 16.

Figure 5:
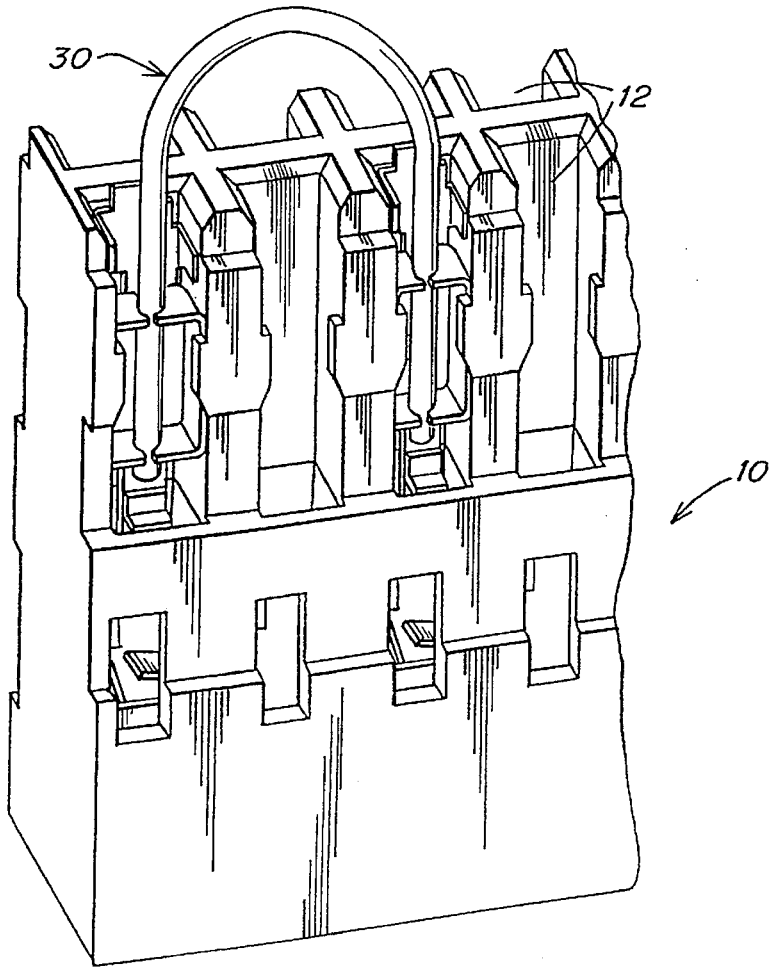
FIG. 5 (PRIOR ART)
FIG. 5 is a view similar to FIG. 2 showing two of the terminals in the prior art connector connected together by a separate insulated wire connection.

If it is required for a certain terminal 16 to be bridged with another terminal in its row for the purpose of providing a loop connector into and out of a printed circuit board or back plane to which the connector is to be fitted, then an insulated length of conductor wire is used for this purpose as is shown by FIG. 5. As shown by FIG. 5, a short length of insulated conductor wire 30 is inserted at its ends into the insulation displacement terminals of the two terminals 16 which it is required to bridge. In FIG. 5, other terminals 16 are not shown for reasons of clarity.

In this conventional process of forming a loop conductor through a multi-terminal connector, several inherent disadvantages have been found. For instance, it is an intricate and slow operation to connect the wire 30 to selected terminals and this adds greatly to the manufacturing process. In addition to this, it is not possible to connect two wires 30 into the insulation displacement ends 26 of one connector 16 for the purpose of connecting the connector to two other connectors. Also an incoming wire cannot be connected to any terminal that is connected to another terminal by a loop conductor such as wire 30. The design of any printed circuit board or back plane is thus hampered by this restriction.

The present invention seeks to minimize or avoid the above disadvantages. This is exemplified in the embodiment now to be described with reference to FIGS. 6 to 12.

Figure 6:
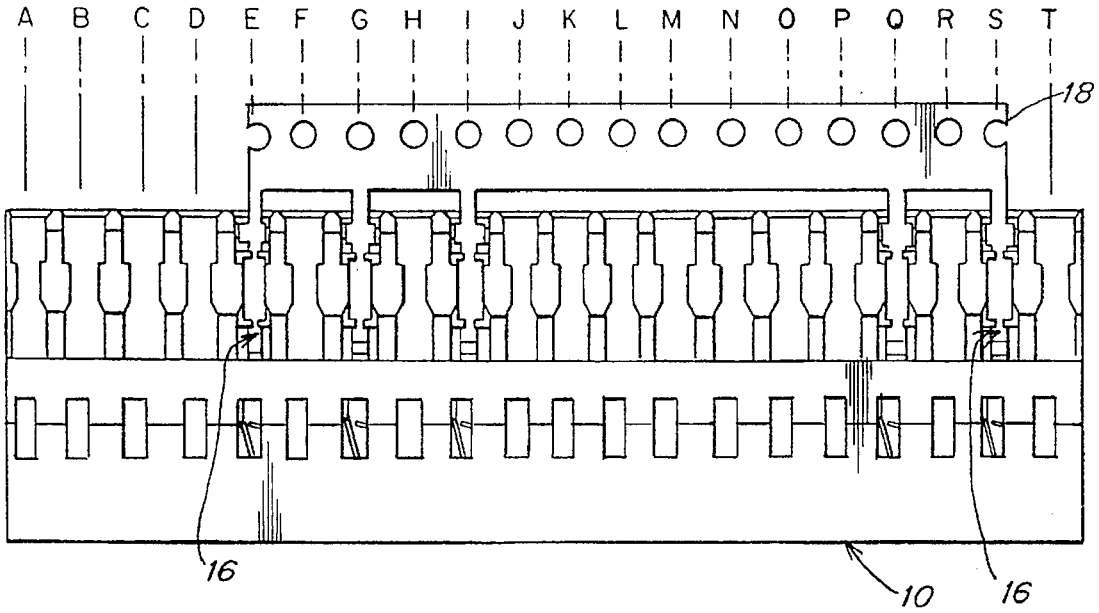
FIGS. 6 and 7 are views similar to FIG. 4 showing different stages in the method of the embodiment for insertion of terminals into a connector to form an assembly according to the embodiment.

In the embodiment as shown by FIG. 6, a conventional connector 10 described with reference to FIG. 1 is shown with terminal positions in one row at one side of the connector alphabetically identified in order from left to right. As shown there are 20 terminal positions and of these terminal positions, it is required that terminals in positions A and C should be electrically connected together to provide a loop conductor and a similar loop conductor should be provided between terminal positions F and H. A further triple loop conductor is to be provided between terminal positions K, M and O with all of the terminals in these positions electrically connected together.

As shown in FIG. 6, a first group of terminal positions E, G, I, Q and S are to be occupied by terminals 20 mounted upon an edge strip 18. The terminals together with the edge strip have been previously separated from a bandolier and of the appropriate length for insertion of the terminals into the connector. The terminals 16 which would correspond to terminals positions A, C, K, M and O which would have provided for a complete alternate group of terminals for insertion into the connector (similar to the conventional method as discussed above) have been removed as these terminal positions are to remain vacant to allow for later insertion of the loop conductors.

Figure 7:
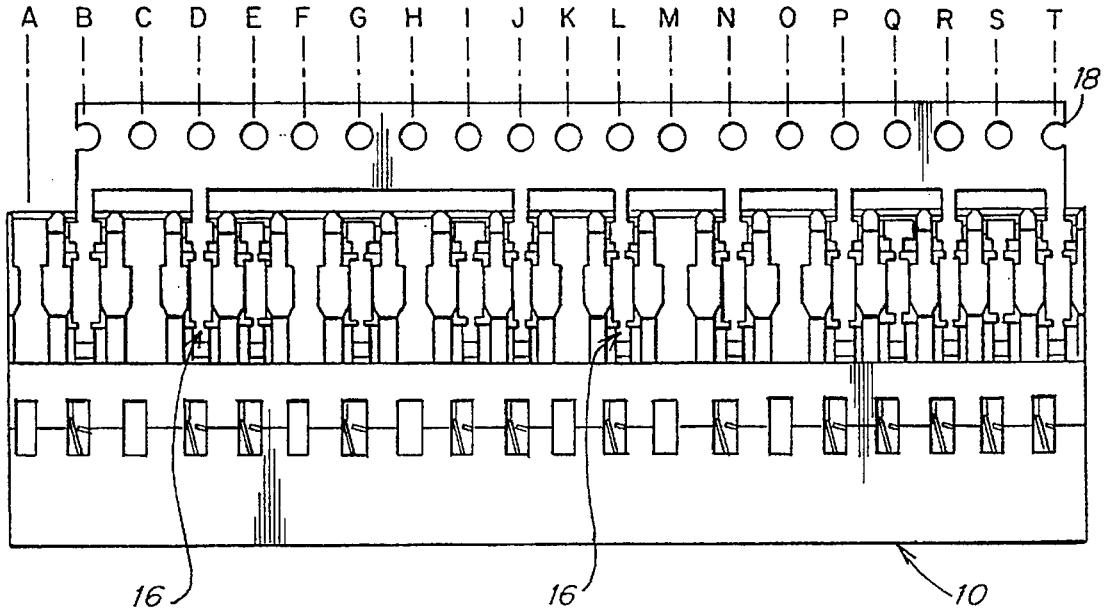

After the edge strip 18 has been removed, and as shown in FIG. 7, further terminals. 16 mounted upon another edge strip 18 are inserted into the terminal positions B, D, J, L, N, P, R and T. The edge strip 18 is then removed and all of these terminals in position in the connector 10 are then in a position isolated electrically from one another.

Figure 8:
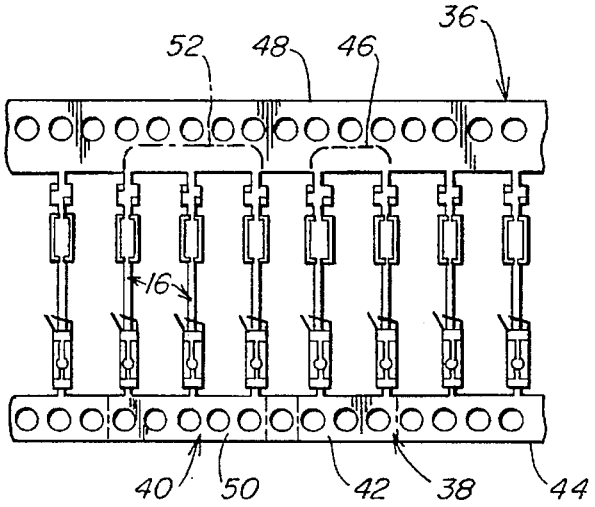
FIG. 8 is a plan view of a bandolier showing the positions of units of selected terminals to be severed from the bandolier and connected by a conductive strip and according to the embodiment.
Figure 9:
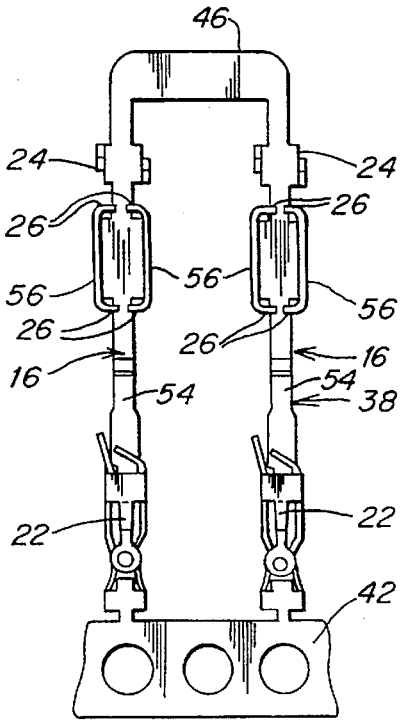
FIGS. 9 and 10 are plan views of two units of terminals and conductive strip to form part of the assembly of the embodiment.

FIG. 8 illustrates a bandolier 36 of similar construction to the bandolier 14 of the first embodiment and having terminals 16. As shown by FIG. 8, integral conductor and conductor strip units 38 and 40 are separated from the bandolier 36. In FIG. 8 one only of each of the units 38 and 40 is shown. As shown by FIG. 9, each unit 38 comprises two of the conductors 16, a short length 42 of an edge strip 44 of the bandolier which connects box ends 22 of the terminals together, and a conductor strip 46 formed from the other edge strip 48 of the bandolier. The edge strip 46 merely extends between the other ends of the terminals 16 and is narrower than the full width of the edge strip 48. Similarly, each of the units 40 (FIG. 10) has a length 50 of the edge strip 44 and a conductor strip 52 connecting three terminals 16 together at their ends 24.

Each of the terminals 16 of the units 38 and 40 comprises a base strip 54 extending from end-to-end of the terminal, the base strip providing part of the box end 22 and carrying upwardly extending side flanges 56 provided with the insulation displacement terminal end 26. The conductor strips 46 and 52 are integral with and extend from the base strips 54.

After the electrically isolated terminals are in position as shown by FIG. 7, terminal positions A and C are then provided with terminals 16 of a unit 38, terminal positions F and H are provided with terminal 16 of another unit 38, and terminal positions K, M and O are occupied by a unit 40. This results in the finished structure of FIG. 11 with a conductor strip 40 extending between terminals of each unit 38 and a conductor strip 52 extending between terminals of the unit 40.

Figure 10:
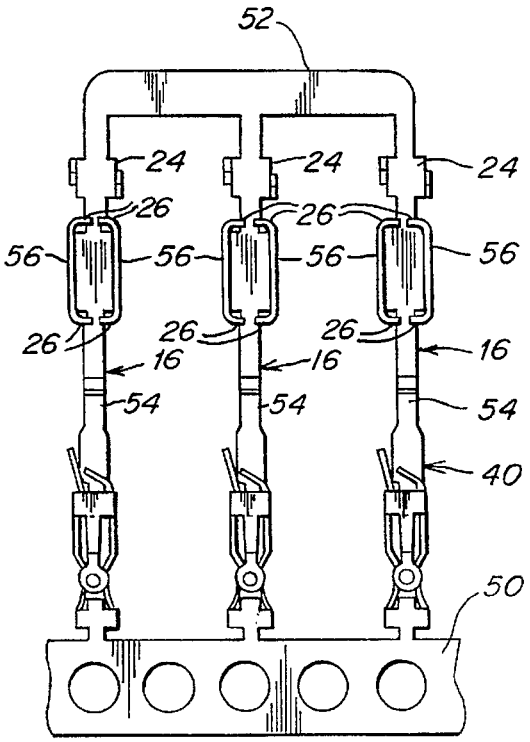
Figure 11:
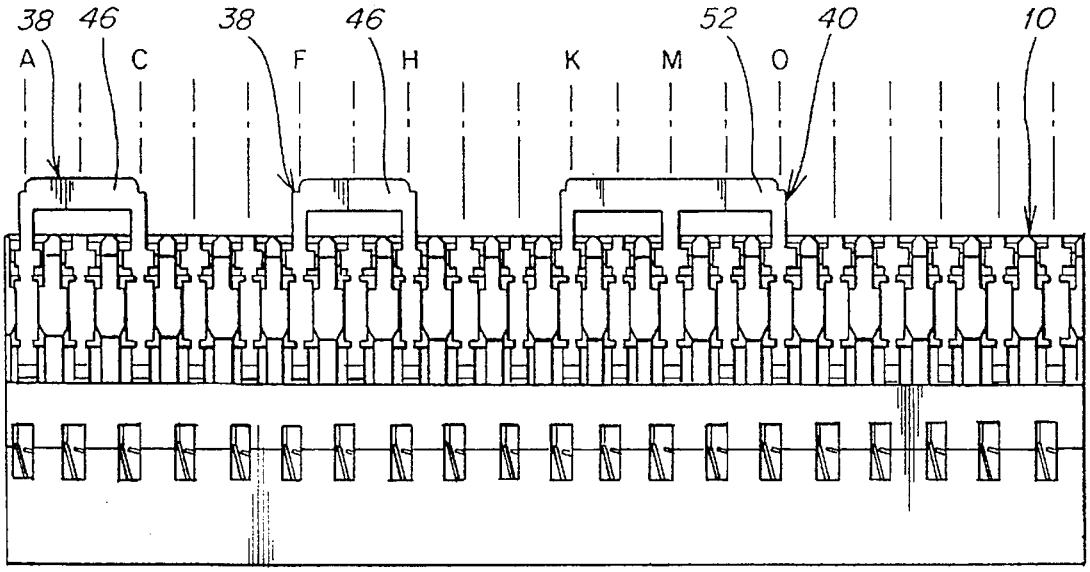
FIG. 11 is a view similar to FIGS. 6 and 7 and showing the embodiment after the final assembly stage.
Figure 12:
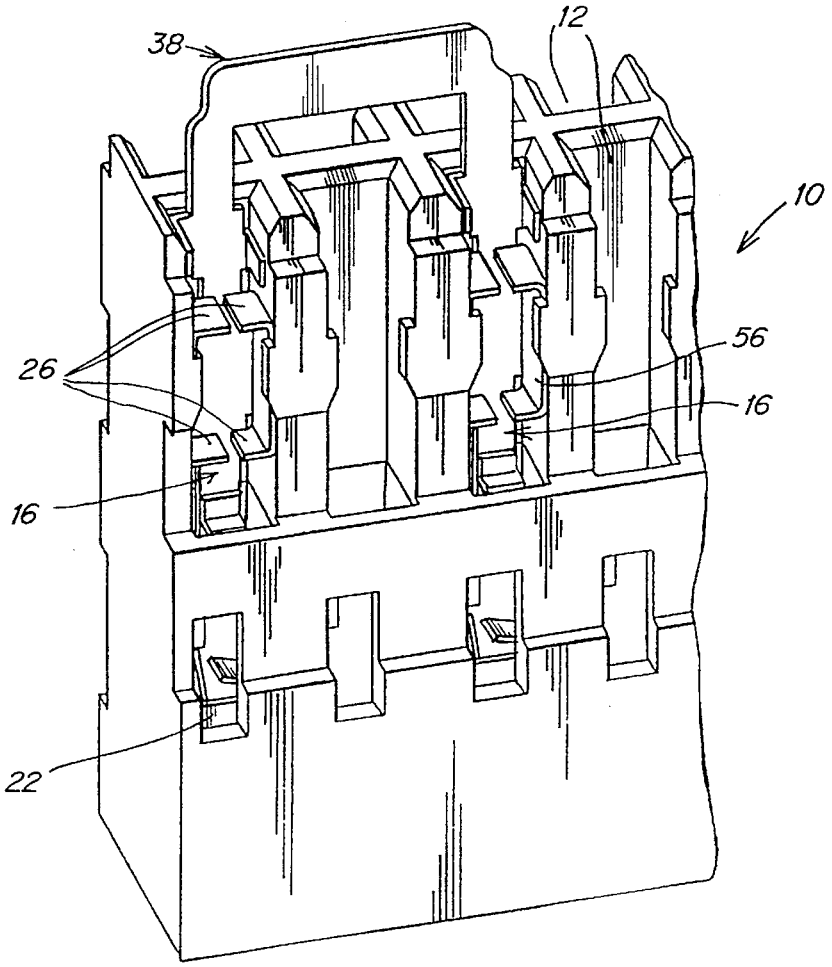
FIG. 12 is a view similar to FIG. 5 showing a unit of selective terminals and conductive strip in position in the connector in the assembly of the embodiment.

It is a relatively simple matter to insert each of the units 38 and 40 into the connector 10 and the insertion of a conductor wire into the insulation displacement ends is thus avoided. Further, as the conductor strips 46, 52 are integral and are stamped out with their associated terminals 16 from a bandolier, there is no weakness in the connection from one terminal 16 to another. Because of the method of making the units 38 and 40, the conductor strips 46 and 52 lie in the plane of the connector 10 and cannot obstruct location of another connector alongside and close to the connector 10. In addition, as shown by FIG. 10, three or more terminals are connectable by a conductor strip which is integral with them. One further significant point is that the terminals of each unit 38 and 40 are electrically connected together without requiring the use of the terminal ends 26 which are thus available, should they be required, for connection to an incoming wire.

What is claimed is:

1. A multi-terminal position telecommunications connector and terminal assembly comprising a telecommunications connector having a housing and a plurality of terminal positions arranged in at least one row, and a row of electrical terminals having an insulation displacement terminal end adapted to receive a wire, the electrical terminals received in the terminal positions within the housing, selected ones of the terminals in the row being electrically connected together by a conductive strip extending from terminal to selected terminal and with selected terminals and the conductive strip forming a single one piece unit with the strip and formed of only piece of conductive material together with the selected terminals.

2. An assembly according to claim 1 wherein each of the selected terminals comprises a box terminal end, an insulation displacement terminal end and an elongate base integrally formed with the box terminal and displacement terminal ends, and the conductive strip extends integrally from one end of the base.

3. A method of making a telecommunications connector comprising:

providing a housing having a row of terminal positions within the housing for electrical terminals;

providing a plurality of electrical terminals having an insulation displacement terminal end adapted to receive a wire, the electrical terminals for location in each of the terminal positions;

and inserting the terminals one into each of the terminal positions with selected ones of the terminals electrically connected together by a conductive strip extending from selected terminal to selected terminal with the selected terminals and the conductive strip forming a single one piece unit formed of only one piece of conductive material, and with others of the terminals being electrically insulated from one another and from the selected terminals.

4. A method of making a telecommunications connector comprising:

providing a housing having a row of terminal positions within the housing for electrical terminals;

providing a plurality of electrical terminals having an insulation displacement terminal end for receiving a wire, for location in each of the terminal positions;

inserting the terminals one into each of the terminal positions with selected ones of the terminals electrically connected together by a conductive strip extending from selected terminal to selected terminal with the selected terminals and the conductive strip forming a single one piece unit and with others of the terminals being electrically insulated from one another and from the selected terminals;

providing the other of terminals from a bandoiler;

inserting the other terminals joined by edge strip means of the bandolier into terminal positions, and removing the edge strip means so as to electrically isolate the other terminals from another;

and then inserting the selected terminals into the selected mounting positions with the conductive strip extending between the selected terminals.

5. A method according to claim 4 comprising providing the unit of selected terminals from a length of bandolier with the conductive strip formed from edge strip means of the bandolier.

6. A method according to claim 5 comprising severing the selected terminals and the conductive strip from the bandolier while severing the conductive strip to have a width narrower than the edge strip means from which it is being removed.

* * * * *